United States Patent [19]

Newlon

[11] 4,102,013

[45] Jul. 25, 1978

[54] TAMPER-PROOF SPRING HINGE

[75] Inventor: Robert L. Newlon, Sterling, Ill.

[73] Assignee: Lawrence Brothers, Inc., Sterling, Ill.

[21] Appl. No.: 749,793

[22] Filed: Dec. 13, 1976

[51] Int. Cl.[2] ..... E05F 1/12; E05D 5/12

[52] U.S. Cl. ..... 16/189; 16/169

[58] Field of Search ..... 16/189, 50, 72, 168, 16/169

[56] References Cited

U.S. PATENT DOCUMENTS

| | | | |
|---|---|---|---|
| 2,520,616 | 8/1950 | Wasson et al. | 16/189 |
| 3,733,649 | 5/1973 | Nagy et al. | 16/169 |
| 3,825,973 | 7/1974 | Gwozdz | 16/189 |

FOREIGN PATENT DOCUMENTS

| | | | |
|---|---|---|---|
| 985,860 | 3/1976 | Canada | 16/50 |
| 1,244,615 | 7/1967 | Fed. Rep. of Germany | 16/189 |

*Primary Examiner*—James Kee Chi

*Attorney, Agent, or Firm*—Olson, Trexler, Wolters, Bushnell & Fosse, Ltd.

[57] ABSTRACT

A plug is offered to make relatively easy and simple the assembly and pre-torquing of a spring-loaded hinge for doors and the like. These hinges comprise a pair of hinge leaves, each leaf defining at least one hollow hinge knuckle aligned with a hinge knuckle defined on the opposite leaf. Through the knuckles, a bi-ended torsion spring mechanism is inserted. A first plug is affixed within one hinge knuckle and engages one end of the torsion spring mechanism. At the opposite knuckle and second spring end, the novel second plug is affixed. This second plug includes a spring-engaging finger and a capstan body adapted to fit snugly within the knuckle. Atop the capstan body is a removable head which can be grasped by a wrench or like torsioning device. After this second plug is inserted in the hinge, the spring end is grasped and torqued by rotating the plug. When the plug and spring are torqued to a predetermined amount, a cross pin is inserted through the adjacent hinge knuckle and capstan body so as to affix the plug in the knuckle. Thereafter increased torque is applied to the plug head, which shears a plane of frangible material interconnecting the plug head and plug capstan, and permits plug head removal. After the head is removed, a covering cap can be inserted into the hinged knuckle at the spot from which the plug head was removed to provide a finished hinge appearance and to inhibit alteration of the correctly set hinge torsional-force-applying capability.

10 Claims, 5 Drawing Figures

TAMPER-PROOF SPRING HINGE

BACKGROUND OF THE INVENTION

This invention relates generally to hinges for doors and the like which are adapted to exert a door-closing force, and more particularly concerns such a hinge which can be relatively easily and quickly assembled at the factory.

Modern building and fire codes for hotels, motels, apartments, condominiums and like structures now often require the installation of door closure devices. For this and several other reasons, door hinges containing coil springs or other devices for automatically closing the related doors have become increasingly popular. One such hinge is purportedly disclosed in U.S. Pat. No. 3,825,973.

One practical problem that has been encountered is the spring hinges are often tampered with after installation to destroy or remove the biasing effect which affords automatic closing of the door. Prior art design such as in the above noted patent are readily susceptible to such tampering. The present invention provides a spring loaded hinge that can be preloaded at the factory and once set cannot be tampered with.

It is accordingly the general object of the present invention to offer an easily assembled door hinge of the type adapted to provide a door-moving torsional force. A related general object is to provide a method for the manufacture of such a door hinge which permits the hinge to be assembled correctly and once assembled is not subject to alteration.

Another object is to provide such a door hinge which discourges both intentional and inadvertant disassembly after the end product is completed at the factory.

Yet another object is to provide such a door hinge in which the force providing the door moving action can be easily, precisely and permanently adjusted at the factory.

Other objects and advantages of the invention will become apparent upon reading the following detailed description and upon reference to the drawings. Throughout the drawings, like reference numerals refer to like parts.

DETAILED DESCRIPTION OF THE INVENTION

While the invention will be described in connection with a preferred embodiment and procedure, it will be understood that it is not intended to limit the invention to this embodiment or procedure. On the contrary, it is intended to cover all alternatives, modifications and equivalents as may be included within the spirit and scope of the invention as defined by the appended claims.

Figure 1:
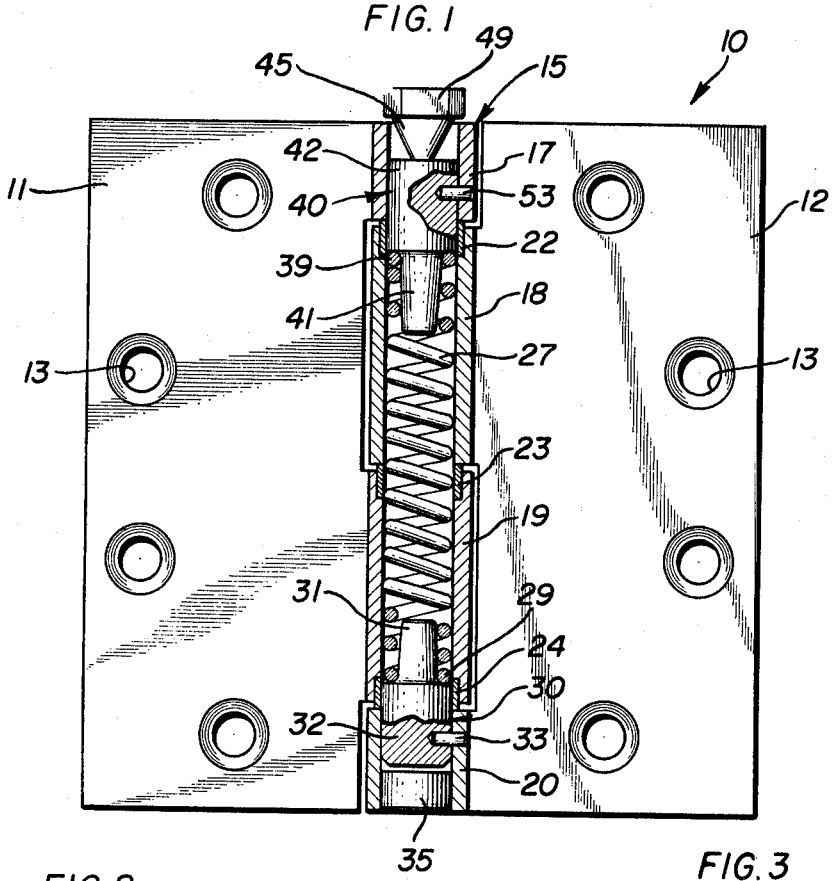
FIG. 1 is an elevational view of the hinge as it appears during a preliminary stage of assembly, portions of the hinge being broken away for clarity.

Turning first to FIG. 1, there is shown a door hinge 10 embodying the present invention. This hinge 10 includes a pair of hinge leaves 11 and 12, within which a number of screw-accepting apertures 13 have been formed to permit the hinge 10 to be mounted to a door and door frame or similar structure. In use, the leaves 11 and 12 rotate about the axis of a central barrel 15 which here comprises a plurality of axially aligned hollow knuckles 17–20 inclusive. These knuckles 17–20 are arranged to interfit; that is, the knuckles 17 and 19 here fixedly depend from a first leaf 11, and opposite knuckles 18 and 20 depend from the second leaf 12. These knuckles are alternately located in axial array so as to interengage with one another and provide the desired hinge action. If desired, small anti-friction bearing members 22, 23 and 24 can be positioned to minimize interleaf friction during hinge action.

To assert forces tending to cause torsional motion of one leaf 11 relative to the other leaf 12, a coil spring 27 in the hinge barrel 15 extends through two or more axially aligned knuckles 18 and 19. The torsional force experienced at a first spring end 29 is received and transfered to an associated knuckle 20 by a first plug 30 inserted into the barrel 15. This plug 30 comprises a spring-engaging finger 31 extending from a main body or capstan portion 32. To fix the plug 30 in its illustrated place and transmit torsional force from the plug 30 to the knuckle 20 and leaf 12, a cross pin 33 extends between the hinge knuckle 20 and the plug capstan 32. When hinge assembly is completed, a finished appearance is provided and hinge tampering is discouraged by a cap 35. Here the cap 35 is carried substantially entirely within the knuckle 20, but is located axially outwardly of the plug 30.

At an opposite or second end 39 of the spring 27, a second plug 40 is located. Like the first plug 30, this second plug 40 includes a spring-end engaging finger 41 which depends from a plug capstan 42.

In accordance with the invention, the hinge 10 can be assembled with relative ease by providing this second plug 40 with a removable head 45 for positioning the plug 40 in and on the hinge knuckle 17. To lower plug cost, the removable head 45 is here formed as a unit with the plug capstan 42. A relatively small plane 47 of frangible material interconnects the head 45 and capstan 42.

Figure 3:
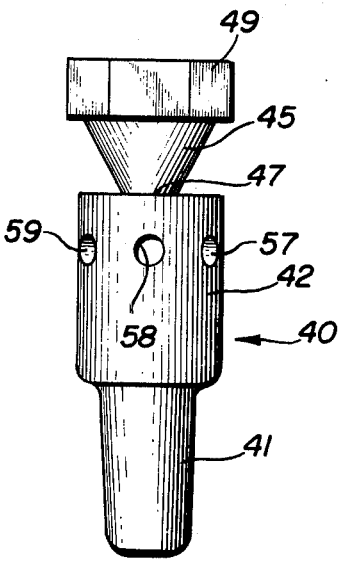
FIG. 3 is an elevational view of a hinge plug used in connection with the invention.
Figure 4:
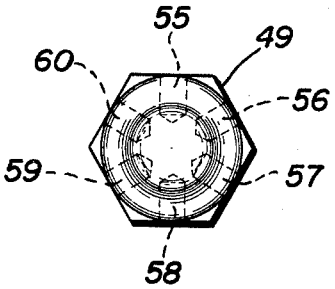
FIG. 4 is a bottom plan view of the hinge plug shown in FIG. 3.
Figure 5:
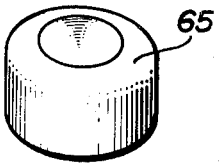
FIG. 5 is a perspective view of a hinge knuckle cap also used in connection with the invention.

In a preferred embodiment of the invention, the entire plug 40 can be easily manipulated into the position illustrated in FIG. 1, and a rotational or torquing force can be applied to the plug so as to pre-load or pre-torsion the spring 27. To this end, the top of the head 45 is adapted to receive a torquing instrument such as a wrench; here, this adaptation takes the form of a hexagonal formation 49, as shown in FIGS. 1, 3 and 4, which tapers throughout a conical body 45 to the frangible plane 47 atop the capstan 42.

Figure 2:
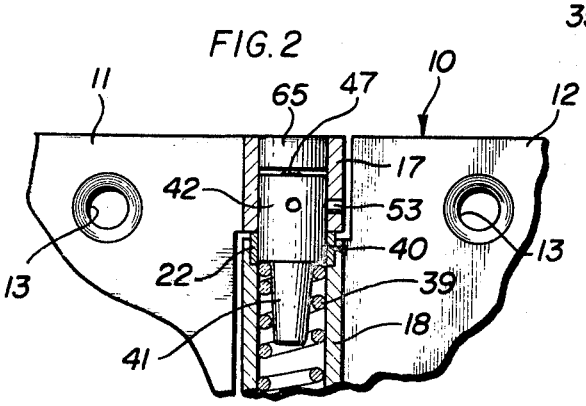
FIG. 2 is a fragmentary view similar to FIG. 1 and showing portions of the hinge as they appear after final assembly has been completed.

By using this plug 40, hinge assembly is made relatively simple and easy. First, the hinge leaves 11 and 12 are preliminarily positioned as shown in FIGS. 1 and 2, and the spring 27 is inserted into the axially aligned knuckles 17–20. The first plug 30 is then inserted so as to engage the abutting spring end 29. The plug 30 is fixed in the illustrated position by the cross pin 33, and the cap 35 is installed.

Next, the novel second plug 40 is inserted into the knuckle 17 and is located at the position illustrated in FIG. 1. To pre-torsion the spring 27, a wrench (not shown) or similar torsioning instrument can be applied to the plug head 45. When an approprate torque indicator revals that the proper amount of torsional force has been applied to the spring 27, a plug-fixing cross pin 53 is inserted through the knuckle 17 located adjacent the plug capstan 42.

It is a feature of the invention that a relatively precise adjustment of the torsional force applied to the spring 27 can be provided. To this end, a number of alternatively selectible pin-accommodating recesses 55–60 are formed within the capstan 42, as can be invisioned from FIGS. 3 and 4. By providing six such pin-accepting recesses as illustrated in FIG. 4, torque-increasing rotational motion of the plug 40 can be halted at any one-sixth, or sixty degrees, of plug rotation.

After the plug-affixing pin 53 is inserted, further torque force is applied to the plug head 45. It is another feature of the invention that this pin 53 is selected so as to provide greater resistance to shear forces than the frangible plug plane 47. Under these circumstances, the head 45 shears or breaks away from the remaining fixed portions of the plug 40 at the plane 47 as shown in FIG. 2, and can be easily removed.

After the frangible plug head 45 has been removed, a covering cap 65 can be inserted into the knuckle 17 to provide a finished hinge appearance. Once assembled the pins 53 and 33 cannot be removed. Further the position of the respective plugs 30 and 40 cannot be changed without permanently damaging or destroying the hinge. As such the resulting spring loaded hinge is tamper-proof and not subject to alterations to destroy the desired spring biasing effect.

While a specific embodiment of the invention has been illustrated and described, it is clear that those skilled in the art and possessed of the present invention may devise various structural changes, modifications or alterations, without departing from the spirit and scope of the invention as defined by the application and the claims appended hereto.

The invention is claimed as follows:

1. Tamper-proof spring biased hinge means comprising a pair of hinge leaves, each leaf defining at least one hollow hinge knuckle aligned with a hinge knuckle defined on the opposite leaf, and a bi-ended torsion spring mechanism within the aligned hinge knuckles, a first plug received within and affixed to one hinge knuckle and engaged with one end of the torsion spring mechanism, and a second plug received within and adapted to be affixed to the second hinge knuckle and engaged with the other end of said second spring mechanism, the second plug including head means having tool engaging surface thereon initially engageable by tool means for pre-torsioning said spring mechanism and means removably joining said head means to the remainder of said second plug thereby rendering said head means removable after said spring is torsioned and said second plug fixed to said second hinge knuckle, with both said first and second plugs being free from any tool engageable means upon removal of said head means.

2. A tamper-proof spring biased hinge according to claim 1 including frangible means interconnecting said head means and said second plug means for permitting the head means to be broken away from said second plug means.

3. A tamper-proof spring biased hinge according to claim 2 wherein said frangible means includes a plane of frangible material located substantially at the juncture of said head and said second plug means.

4. A tamper-proof spring biased hinge according to claim 1 including means for affixing the second plug means within said knuckle and for resisting motion as the head means is removed from said second plug means.

5. A tamper-proof spring biased hinge according to claim 4 wherein said means for affixing the plug means includes a cross pin.

6. A tamper-proof spring biased hinge according to claim 1 wherein said means removably joining said head to said second plug means includes a frangible section, and there is further included pin means for securing said second plug means to said second knuckle, said pin having a shear strength sufficient to withstand any forces exerted thereon when said frangible section is fractured upon removal of said head from said second plug means.

7. A tamper-proof spring biased hinge means comprising a pair of hinge leaves, each leaf including at least one hollow hinge knuckle aligned with a knuckle on the opposite leaf, bi-ended pre-torsioned spring means disposed within said knuckles, a first plug member engaged with one end of said spring means and received in one of said knuckles and fixed against rotation with respect to the associated leaf, a second plug member engaged with the other end of said spring means and received in the other knuckle and fixed against rotation with respect to the other leaf, both said first and second plug members being disposed entirely interiorly of said knuckles, one of said plug members being initially provided with tool engageable means, which means was joined to said plug member for pre-torsioning of said spring means, and then removed after said plug members were fixed against rotation, and both said plug members in the assembled condition being free from any tool engageable means accessible through said knuckles, thereby rendering said hinge substantially tamper-proof in the assembled condition.

8. A tamper-proof hinge according to claim 7 wherein said tool engageable means was joined to said plug by a frangible connection, said connection being severed during assembly of said hinge and after pre-torsioning of said spring means to effect removal of said tool engageable means.

9. A tamper-proof spring biased hinge according to claim 7 wherein each said plug is disposed inwardly of the open ends of said knuckles and cap members are disposed in said open ends.

10. A tamper-proof hinge according to claim 9 wherein said cap members are disposed entirely within said knuckles and substantially flush with the open ends thereof.

* * * * *